United States Patent [19]

Sanborn et al.

[11] Patent Number: 4,574,685

[45] Date of Patent: Mar. 11, 1986

[54] TURRET SYSTEM FOR LIGHTWEIGHT MILITARY VEHICLE

[75] Inventors: Steven L. Sanborn, Warren; Martin J. Neumeyer, Utica, both of Mich.

[73] Assignee: AM General Corporation, Detroit, Mich.

[21] Appl. No.: 736,218

[22] Filed: May 20, 1985

Related U.S. Application Data

[63] Continuation of Ser. No. 506,802, Jun. 22, 1983.

[51] Int. Cl.[4] ..... F41F 21/08; F41F 23/10

[52] U.S. Cl. ..... 89/37.14; 89/40.03; 89/41.05; 89/41.12; 89/42.01; 89/44.02; 89/36.13

[58] Field of Search ..... 89/36.08, 36.13, 37.03, 89/37.14, 37.17, 40.03, 41.01, 41.02, 41.05, 41.12, 42.01, 44.02

[56] References Cited

U.S. PATENT DOCUMENTS

| | | | |
|---|---|---|---|
| 381,475 | 4/1888 | Koerner | 89/42.01 |
| 641,897 | 2/1900 | Simms | 89/41.05 |
| 853,625 | 5/1907 | Charron | 89/40.03 |
| 1,322,124 | 11/1919 | Lawrence | 89/37.03 |
| 2,367,837 | 1/1945 | Stevens | 89/40.03 |
| 2,399,200 | 4/1946 | Brown | 89/41.12 |
| 2,439,105 | 4/1948 | Sanford et al. | 89/37.14 |
| 2,528,645 | 11/1950 | Edwards | 89/41.12 |
| 3,316,809 | 5/1967 | Riedel | 89/1.815 |
| 3,357,718 | 12/1967 | Cadiou | 280/96.1 |
| 3,424,052 | 1/1969 | Ruf | 89/37.03 |
| 3,429,222 | 2/1969 | Whiston et al. | 89/41.02 |
| 3,501,997 | 3/1970 | Winsen et al. | 89/44.02 |
| 3,504,122 | 3/1970 | Ratliff, Jr. | 89/41.05 |
| 3,566,742 | 3/1971 | Bemiss | 89/40.03 |
| 3,854,377 | 12/1974 | Schiele | 89/36.13 |
| 3,954,041 | 5/1976 | Mechulam et al. | 89/36.13 |
| 4,054,080 | 10/1977 | Rossel et al. | 89/36.08 |

FOREIGN PATENT DOCUMENTS

| | | | |
|---|---|---|---|
| 652191 | 11/1962 | Canada . | |
| 798816 | 5/1936 | France | 89/37.17 |
| 849186 | of 1939 | France . | |
| 489059 | 7/1938 | United Kingdom | 89/37.17 |
| 492583 | 9/1938 | United Kingdom . | |
| 1019430 | 2/1966 | United Kingdom | 89/41.01 |

OTHER PUBLICATIONS

Popular Mechanics, "Remote Control Gun is Fired from Inside Car", May, 1945, p. 49.

Hoeltzel et al., "2 Fighting Vehicle Concept Designs", Army Research Development & Acquisition Magazine, Nov.-Dec., 1982, p. 19.

*Primary Examiner*—Stephen C. Bentley

*Attorney, Agent, or Firm*—Harness, Dickey & Pierce

[57] ABSTRACT

A lightweight military vehicle is provided with an unmanned turret for interchangeably supporting large weapon stations. Elastomer filled stanchions connected to a turret platform serve to isolate weapon impulse forces from the vehicle frame. Driver, commander and gunner seats are located externally to the turret and provided with side doors to enable quick exiting. Both powered and manual backup drives are external to the rotating turret disk and are accessible from the gunner's seat. The elevation drive employs a ball and socket joint connecting an upper yoke mounted to the weapon with a fixed lower portion controlling vertical movement of the yoke and thereby the elevation of the gun.

45 Claims, 8 Drawing Figures

TURRET SYSTEM FOR LIGHTWEIGHT MILITARY VEHICLE

This is a continuation of application Ser. No. 506,802, filed June 22, 1983.

DESCRIPTION

1. Technical Field

This invention relates to ordinances and, more particularly, to weapon turret systems for a military vehicle.

2. Background Art

It is highly desirable to be able to employ a basic vehicle design that can be adapted to be used in various configurations for different military purposes. Examples of such desirable configurations include vehicles for transporting cargo or personnel, ambulances, command vehicles and as a weapons caarrier. In order to provide this versatility where speed is important in most configurations and to facilitate transport by airlifts and the like, the basic vehicle mus normally be relatively light.

When used as a weapons carrier these lightweight vehicles have generally been restricted in the size of the weapon that it can support. It has been conventional to mount manually operated machine guns on a ring connected to the roof of the vehicle. The gunner is required to stand up in the vehicle with his upper torso exposed while aiming and firing the weapon. These types of weapon mounts have several drawbacks. One is that they expose the gunner to enemy fire, toxic gases, radiation and the like. The other is that only relatively small caliber weapons could be used with reasonable success. This is because the impulse forces generated by many larger caliber weapons (e.g. larger than 0.50 caliber) create such impulses that damage to commonly used lightweight vehicles could occur.

It has been normal practice to use heavier vehicles such as tanks, half-tracks or the like to support medium to large caliber weapons. Typically, the tanks include a turret having a protected personnel compartment which carries the gunner and is rotated with the turret. This approach keeps the gunner shielded but adds substantial weight and increased silhouette to the vehicle. Consequently, these heavier vehicles sacrifice mobility and transportability in order to protect the gunner and support the weapon. Additionally, many of the known tank configurations are characterized by cramped quarters which are uncomfortable and hard to quickly exit in emergency situations. Many tanks include hatches in the hull roof structure thereby requiring that the turret be indexed to a position that will allow the hull hatch to open to allow exiting by the crew.

Power drives are normally used for controlling the elevation and azimuth of the weapon. The power drives are often located in the turret thereby requiring slip rings or the like to transfer power from a fixed external electrical or hydraulic source to the drive motors. These slip rings are subject to corrosion and general deterioration thereby posing a threat of drive failure. It would be advantageous to provide manual backup systems that can manuever the weapon in the event of power failure. The inclusion of manual backup drives has been dificult to obtain in an efficient manner with some of the turret construction used in the past.

SUMMARY OF THE INVENTION

The present invention incorporates several features that may be used alone or in combination but when combined cooperate to provide an optimum lightweight vehicle construcion capable of supporting relatively large weapon systems.

The preferred embodiment employs a turret construction having a disk rotatably mounted on a platform. The platform is connected to the vehicle frame by way of a plurality of stanchions. Preferably, the stanchions are potted or filled with a elastomeric material to help isolate the vehicle from impulse forces generated by the weapon. The crew sits in chassis/hull mounted seats, one of the seats being reserved for a gunner. The crew is thus provided with comfortable quarters and are preferably provided with exterior side doors adjacent each seat for quick exit if required. Both powered and manual backup drives are provided for moving the weapon in elevation and azimuth. The elevation drive includes a stationarily mounted lower portion having a manually actuable member accessible by the gunner from his seat. The upper portion of the elevation drive is rotatably coupled to the lower portion so that the upper portion may rotate with the turret during azimuth positioning and yet still provide elevation control.

Among the advantages of the turret construction of this invention is that the crew members are located comfortably within the protected interior of the vehicle. Since the gunner does not ride in the turret, the turret construction is simplified, of minimal silhouette and comparatively lightweight. As will appear, the construction of the present invention enables various weapons and/or weapon stations to be interchangeably used in an easy manner. All of these advantages and more are provided while employing a basic lightweight vehicle design that can be used in a variety of other configurations as desired.

BRIEF DESCRIPTION OF THE DRAWINGS

These and other advantages of the present invention will become apparent to those skilled in the art after reading the following specification and by reference to the drawings in which.

DESCRIPTION OF THE PREFERRED EMBODIMENT

Figure 1:
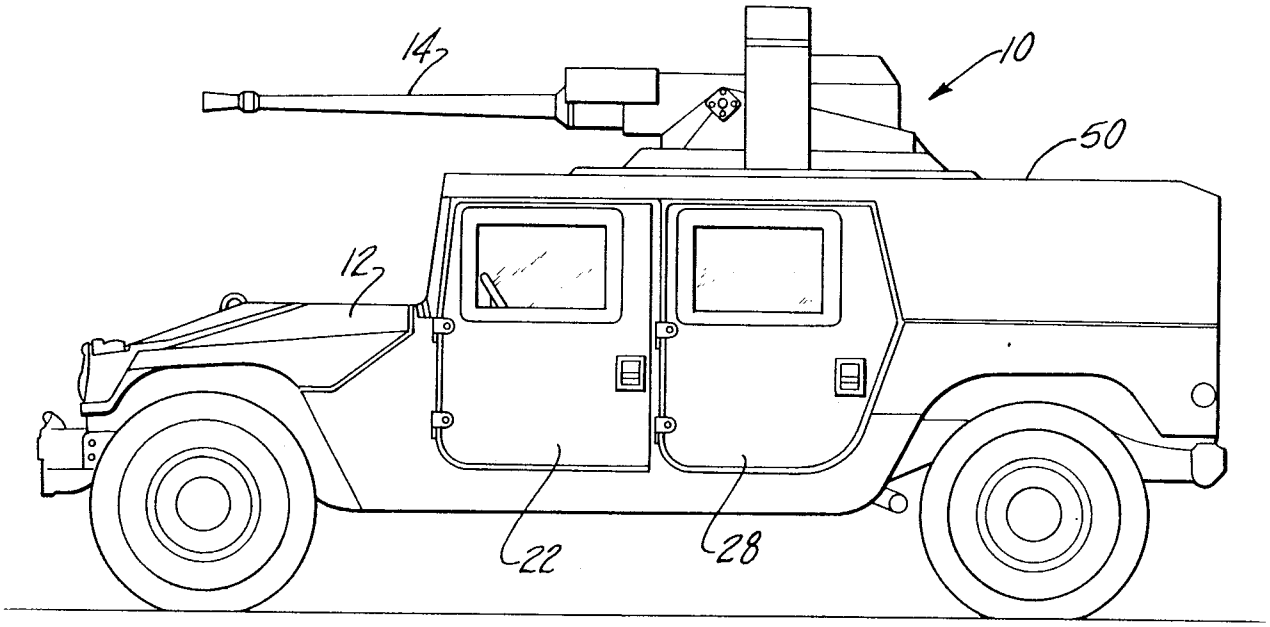
FIG. 1 is a side view of a military vehicle incorporating the teachings of the preferred embodiment of this invention.

Referring now to the drawings, the present invention employs a turret system 10 that may be used in connection with a lightweight vehicle 12. Vehicle 12 is designed to meet requirements for a high mobility, multipurpose wheeled vehicle. For purposes of this invention a lightweight vehicle means a wheeled vehicle having a gross vehicle weight of less than 10,000 pounds including payload. These drawings illustrate the "Hummer" vehicle manufactured by the assignee of the present invention, although other lightweight vehicles can be employed. Such lightweight vehicles are capable of being used in various configurations. One configuration is as a weapon carrier. The present invention is drawn to this configuration. More particularly, it is directed to a turret construction capable of supporting large weapons such as gun 14 which is a 25 millimeter M242 chain gun. Large weapons will be defined for purposes of this invention as weapons characterized by impulse forces (recoil force×duration) of at least about 50 pounds-seconds during firing. Generally, weapons of this type are of the variety greater than 0.50 caliber. By way of illustration the M242 chain gun 14 exhibits an impulse force of about 60 pounds-seconds.

Figure 2:
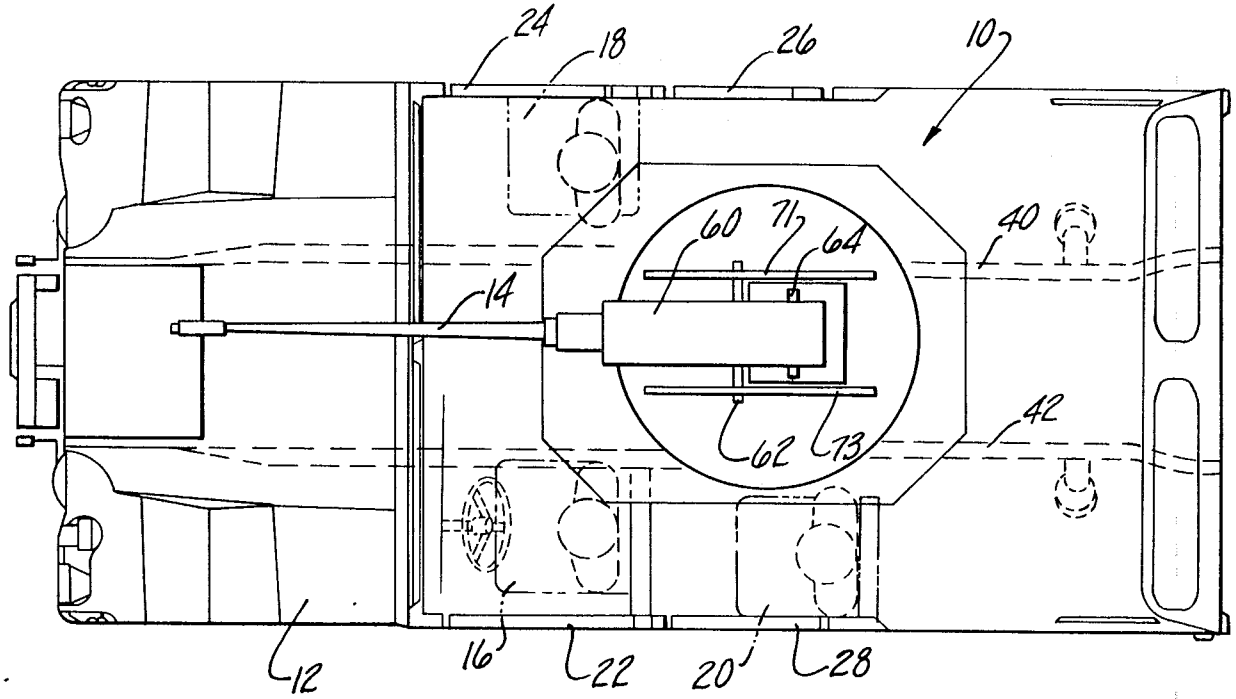
FIG. 2 is a top view thereof.
Figure 3:
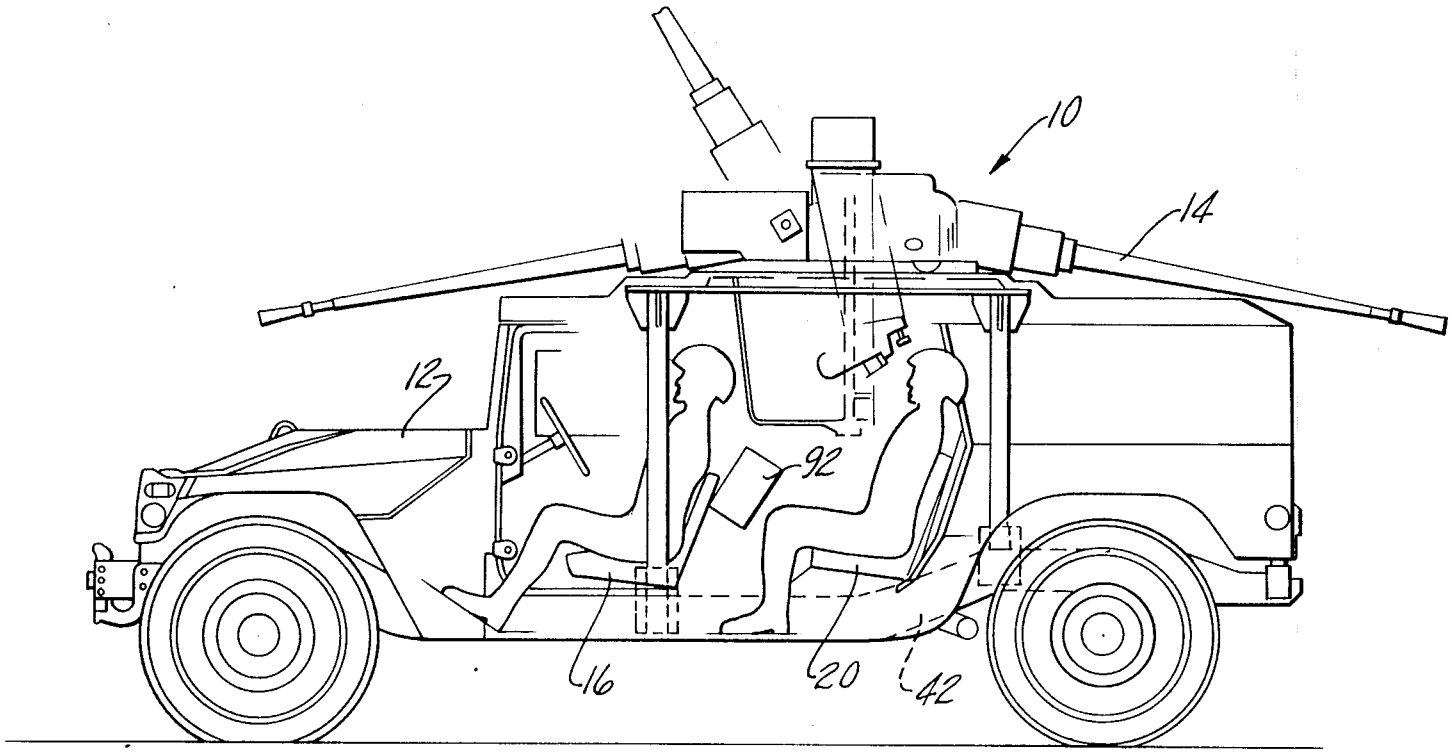
FIG. 3 is a view similar to FIG. 1 of the vehicle showing the gun in various orientations.
Figure 4:
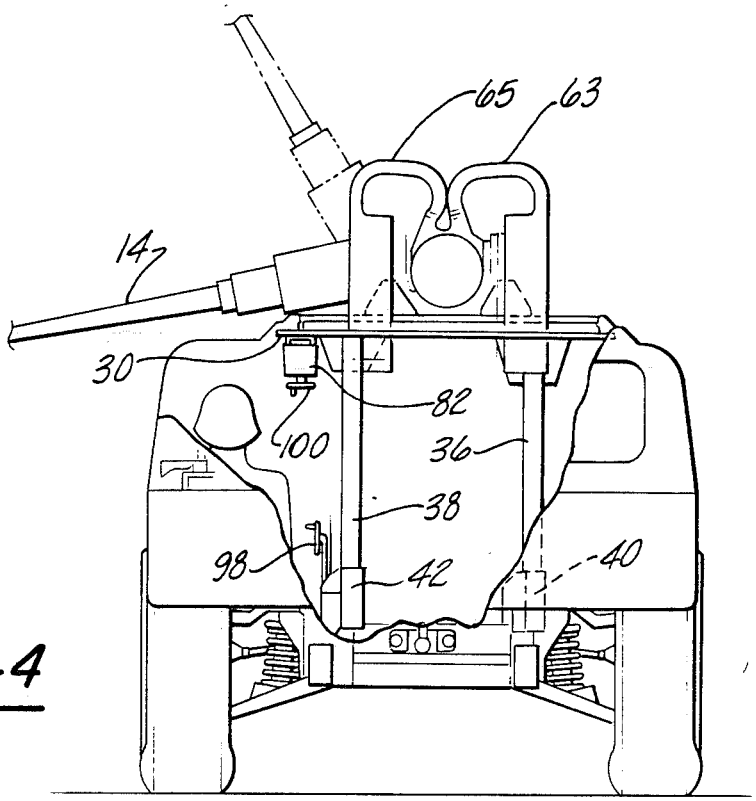
FIG. 4 is a rear view thereof.

The exterior of vehicle 12 is provided with armor for protecting the crew seated in the interior of the vehicle. As can be seen most clearly in FIG. 2, a plurality of forward mounted, forward looking seats 16, 18 and 20 are provided in the interior of the vehicle 12. Seat 16 is for the driver, seat 18 for the commander and seat 20 for the gunner. Each member of the crew is provided with his own access door immediately adjacent to his respective seat. In this example there are four doors 22–28.

The crew's seating arrangement of this invention provides comfort and safety for the personnel. The crew members are seated in normal passenger car fashion with 360 degree visibility through windows surrounding the crew seating area. The gunner's seat is located outside of the turret 10 in a comfortable vehicle seat from which he can perform the gunner functions while seated and protected.

Figure 5:
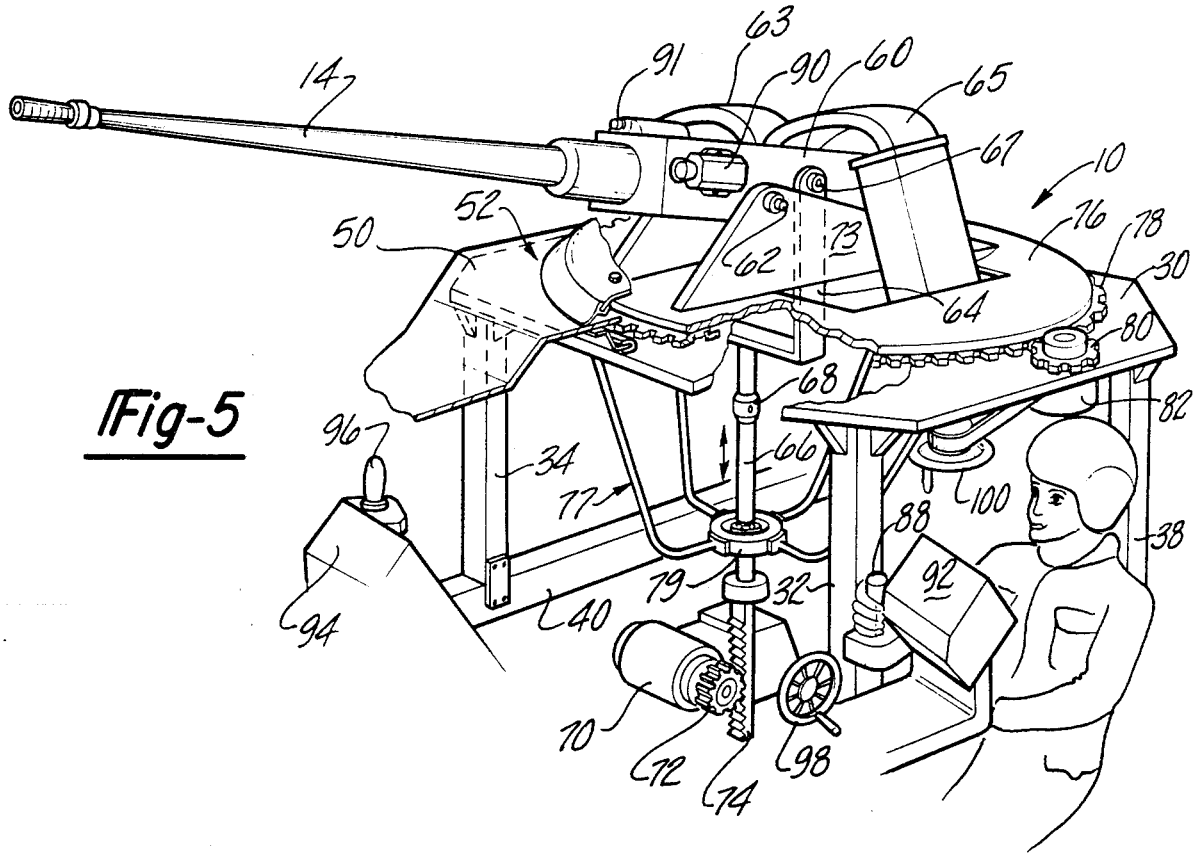
FIG. 5 is a perspective view with parts cut away of the turret construction preferably employed.

Turn now to the construction of turret 10 which is best illustrated in FIG. 5. A platform 30 having a generally rectangular periphery extends horizontally above the crew near the top of the vehicle 12. A plurality of vertically extending stanchions 32–38 are employed to support the platform 30. Upper ends of stanchions 32–38 are connected to lower portions of platform 30 and their lower ends are bolted to side rails 40 and 42 which are part of the vehicle frame. As can be seen most clearly in FIGS. 6 and 7, each stanchion includes a rectangular extruded aluminum casing 44 and an inner hollow aluminum tube 46. The space between outer casing 44 and tube 46 is filled with an energy absorbing elastomeric material 48. In the preferred embodiment, elastomeric material 48 is a polysulfide available from 3m Corporation as EC 801, which may be suitably mized and poured within the space between casing 44 and tube 46 and allowed to cure. Suitable other energy absorbing materials such as sand may be used.

Figure 6:
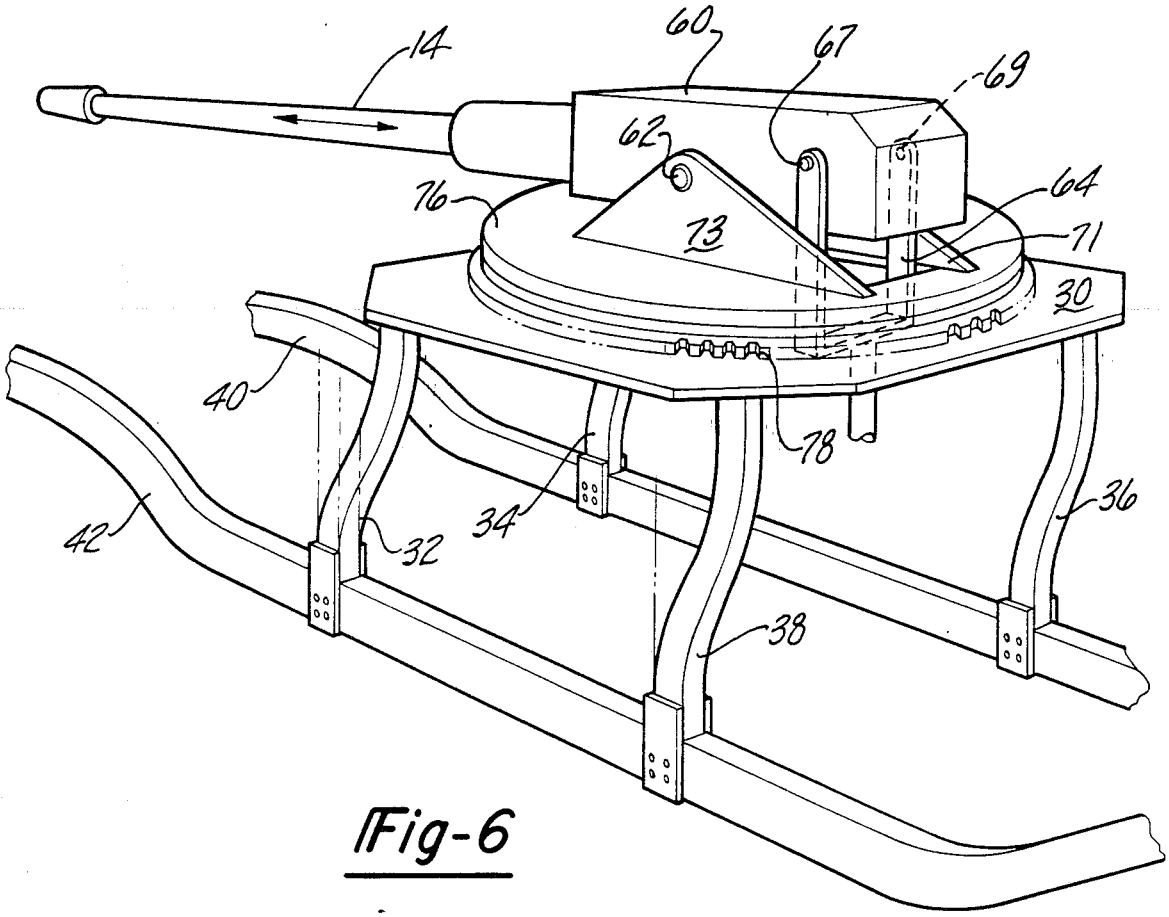
FIG. 6 is a perspective view diagramatically illustrating flexure of the turret stanchions during firing of the weapon.
Figure 7:
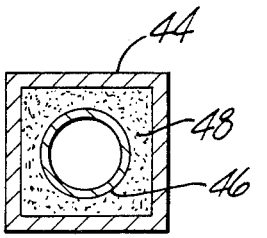
FIG. 7 is a cross sectional view throw one of the stanchions.

Gun 14 is located centrally to the stanchions 32–38 so that the horizontal component of the gun impulse force is distributed amongst the stanchions. As shown in FIG. 6, the stanchions are designed to flex or deflect in response to the forces during firing of the gun and thereby isolate the vehicle frame from damage to a great extent. The elastomeric material 48 in each stanchion serves to absorb energy created by the weapon and prevents much of it from being transferred directly to the vehicle frame.

Figure 8:
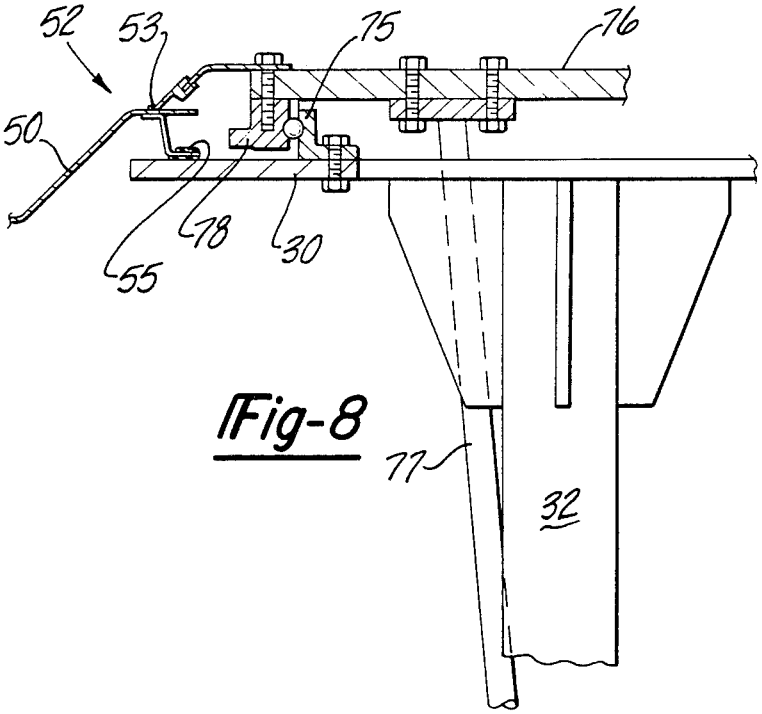
FIG. 8 is a cross sectional view illustrating in detail the turret bearing and sealing arrangements.

The platform 30 is free to move in the horizontal direction independently of the roof 50. As best shown in FIG. 8, there is a gap between roof 50 and platform 30. Weather seal 52 includes a resilient lip portion 53 riding on roof 50 that provides a friction joint with the roof or vehicle superstructure. Lower portions of seals 52 are connected to platform 30 by way of suitable fasteners 55.

Gun 14 is mounted in a cradle 60 which is pivotable about a pair of trunnions 62. Ammunition is fed to the gun 14 by way of dual ammunition feeds 63 and 65. The cradle 60 includes a rearwardly extending portion connected to vertically extending struts of a yoke 64 through bearings 67 and 69. The lower portion of yoke 64 is pivotally connected to a shaft 66 by way of a ball and socket joint 68. Elevation of gun 14 is controlled by the vertical movement of shaft 66 likewise causing motion in the vertical direction of yoke 64 thereby pivoting the gun about its trunions 62. Power drive is provided via motor 70 controlling rotation of a pinion 72 in engagement with rack 74.

Azimuth control of gun 14 is provided by way of a rotating disk 76 to which cradle 60 is connected by way of trunnion mounts 71 and 73. As shown most clearly in FIG. 8, disk 76 is located within an opening in roof 50 and is bolted to a ring gear 78 which is incorporated in the outer race of the turret bearing whose inner race 75 is bolted to platform 30. Ring gear 78 includes radially extending teeth on its outer periphery. The teeth of gear 78 are meshed with a pinion 80 (FIG. 5) whose rotation is controlled by drive motor 82. In addition to its energy absorbing function, weather seal 52 bridges the gearing arrangement protecting it from adverse environmental conditions and also serving as a balistic shield.

Added stability for the elevation drive is provided by way of a basket 77. Basket 77 includes a plurality of struts whose upper ends are connected to the lower portions of platform 30 and whose lower ends are connected to a bearing guide 79 surrounding shaft 66.

As noted before, the gunner sits externally of the turret 10 in a comfortable and protected position within the vehicle. The gunner is provided with a suitable joy stick-type controller 88 for activating elevation motor 70 and azimuth motor 82 to aim the gun. A video camers 90 coaxially mounted to gun 14 is advantageously employed as a sighting device. An auxiliary laser beam sight 91 may also be employed. Camera 90 is connected to display 92 for viewing by the gunner. Other crew members such as the commander may also be provided with their own display and controller 94 and 96, respectively, so that they can also operate the weapon system, if desired.

The turret system of the present invention also preferably includes manual backup drives to control the gun in the event of power failure. To this end, a wheel 98 is connected by way of a clutching arrangement to drive pinion 72 in the event of power loss. Additionally, a wheel 100 suitably connected to pinion 80 via a belt or chain is employed for effecting azimuth movement of the gun.

Among the advantages of the present invention is that various weapon stations can be interchangeably used with this construction. Each weapon station would include a particular type of weapon mounted on its own disk in a manner like that described above. Each weapon station can be easily removed from the vehicle by unbolting the disk 76, disconnecting yoke 64, and disconnecting the cables coupling camera 90 to the video displays and controllers 92, 96 to the weapon firing mechanisms (not shown). The weapon station can then be lifted from the vehicle and a new weapon station with a similar mounting scheme reattached. The video displays, gunner controls, manual and power drives all remain fixed and are common to all weapon variants. This system is ideally suited, but not limited to weapons such as a 30 mm chain gun, Tow family of missiles, 40 mm grenade launcher, 0.50 caliber machine guns, 7.62 mm machine guns and other high velocity guns including the illustrated 25 mm chain gun.

The unmanned turret system of this invention extends the capability of lightweight conventional vehicles to support high impulse weapons. This allows the light vehicle to employ high impulse cannons designed to deliver ammunition at extended ranges.

Various other advantages and modifications of the illustrated embodiment of this invention will become apparent to those skilled in the art after a study of the drawings, specification and following claims.

We claim:

1. In a lightweight military vehicle, an improved turret system adapted for use with large weapons, said turret system comprising:

a platform;

a plurality of vertically extending stanchions connected at their upper ends to the platform and at their lower ends to side rails of the vehicle frame each of said stanchions including an outer casing and an energy absorbing material filling the outer casing, and being of a different material than the outer casing;

a disk mounted for rotation about a vertical axis on said platform;

mounting means connected to the disk for receiving a large weapon and being adapted to pivot the weapon in elevation about a pair of horizontally disposed trunnions;

elevation drive means vertically extending upwardly from central interior portions of the vehicle for controlling elevation of the weapon, said drive means having a lower fixed actuator portion rotatably coupled to an upper portion, said upper portion being connected to the weapon mounting means offset from the trunions whereby vertical motion thereof controls elevation of the weapon, with said upper portion being capable of rotating with the weapon during azimuth positioning thereof:

a plurality of forward looking seats within the interior of the vehicle, one seat being for a gunner;

power drive control means accessible from the gunner's seat for activating the elevation drive means and for rotating the disk to move the weapon in elevation and azimuth, respectively; and manual control means accessible from the gunner's seat for manually actuating the elevation drive means and for rotating the disk as a backup to the power drive control means.

2. The vehicle of claim 1 wherein said stanchions absorb impulse forces generated during firing of the weapon.

3. The vehicle of claim 1 wherein said elevation drive means includes:

an upper yoke member connected by a way of ball and socket joint to a shaft, upper ends of the yoke being connected to the weapon mounting means and lower portions of the shaft being engaged with a gearing arrangement for controlling verticle movement thereof.

4. The vehicle of claim 3 wherein said gearing arrangement includes a rack connected to the shaft, and a pinion driven by a motor activated by the power drive control means or alternatively by the manual control means.

5. The vehicle of claim 1 which further includes exterior side doors adjacent each seat.

6. The vehicle of claim 1 which further includes:

bearing means having a ring gear with teeth;

means for removably mounting said disk to the ring gear; and a pinion engaging said gear ring for rotating the disk and moving the weapon in azimuth.

7. The vehicle of claim 6 wherein the vehicle includes a roof spaced from said platform and including an opening in which said disk is located, and weather seal means between upper portions of said disk and said roof bridging said ring gear.

8. The vehicle of claim 7 wherein said weather seal means includes a resilient portion contacting the roof whereby friction energy created by relative motion between the platform and roof serves to absorb a portion of the weapon energy during firing and isolates the vehicle roof from weapon impulse forces.

9. The vehicle of claim 6 wherein said pinion is rotatable either by a motor actuated by the power drive control means or by said manual control means.

10. The vehicle of claim 1 which further includes:

a camera mounted coaxially with the weapon adapted to be used as a sighting device, and a video display connected to the camera and located in view of the gunner.

11. In a vehicle having a frame, the improvement comprising:

a platform, a weapon mounted to the platform, and a plurality of vertically extending stanchions connected at their upper ends to the platform and at their lower ends to the vehicle frame, with the stanchions including an outer casing, and an energy absorbing material filling the outer casing and being of different material than the outer casing material whereby said stanchions flex during firing of the weapon to thereby minimize the transfer of weapon impulse forces to the vehicle frame.

12. The improvement of claim 11 wherein each of said stanchions comprises:

a metallic outer casing and an interior hollow tube, and energy absorbing elastomeric material filling the space between the tube and inner walls of the casing.

13. The improvement of claim 11 wherein said vehicle frame includes a pair of side rails running parallel to the length of the vehicle, and wherein said weapon is about centrally located with respect to the stanchions so that the impulse force created thereby is distributed to the stanchions.

14. In a vehicle for carrying a weapon, the improvement comprising:

a platform for supporting the weapon and being capable of moving relative to the vehicle, a plurality of stanchions connected at their one ends to the platform and at their opposite ends to the vehicle, with the stanchions including an outer casing and an energy absorbing material filling the outer casing, and being of different material than the outer casing whereby said stanchions flex during firing of the weapon to thereby minimize the transfer of weapon impulse forces to the vehicle.

15. The improvement of claim 14 wherein each of said stanchions comprises:

a metallic outer casing and an interior hollow tube, and energy absorbing elastomeric material filling the space between the tube and inner walls of the casing.

16. The improvement of claim 14 wherein said vehicle is a land vehicle including a frame having a pair of side rails running parallel to the length of the vehicle, and wherein said stanchions are substantially equally spaced about the weapon so that the impulse force created thereby is substantially equally distributed to the stanchions.

17. The improvement of claim 16 wherein said vehicle is a lightweight military land vehicle and wherein said weapon is a large weapon.

18. The improvement of claim 17 wherein said vehicle includes a roof portion with an opening therein, with the platform being located underneath the roof opening, said weapon being mounted on a disk adapted for rotation on the platform, and said vehicle further including azimuth drive means for rotating the disk and elevation drive means for controlling elevation of the weapon.

19. The improvement of claim 18 which further includes power control means including at least one motor for activating the elevation and azimuth drive means; and manual control means for manually actuating the elevation and azimuth drive means as a back-up to the power control means.

20. The improvement of claim 19 wherein said elevation drive means includes:

a first elongated member centrally disposed about the axis of rotation of the disk, a second member coupled to the weapon, and means defining a rotating coupling between the first and second members constructed so that vertical movement of the first member controls elevation of the weapon, with said second member being capable of rotating with the weapon during azimuth positioning thereof.

21. The improvement of claim 20 wherein said first member comprises a rack, and said elevation drive means including a pinion for engaging the rack, with the power control means including a motor for imparting rotational movement to the pinion thereby controlling vertical movement of the rack, and wherein said manual control means includes means for manually rotating the pinion.

22. The improvement of claim 18 wherein said azimuth drive means includes:

a ring gear mounted to the periphery of the disk and having radially outwardly extending teeth, a second pinion mounted on the platform and engaging said ring gear, with said power control means including a motor for imparting rotational movement to the pinion and wherein said manual control means includes means for manually rotating said second pinion.

23. The improvement of claim 22 wherein said vehicle includes a plurality of forward looking seats, one of the seats being a gunner's seat, both of said manual and power control means being accessible from the gunner's seat, and wherein said vehicle further includes exterior side doors adjacent each seat.

24. The improvement of claim 23 wherein the vehicle includes weather seal means between said disk and said roof bridging said ring gear.

25. The improvement of claim 24 wherein said weather seal means includes a resilient portion contacting the roof whereby friction energy created by relative motion between the platform and roof serves to absorb a portion of the weapon energy during firing and isolates the vehicle roof from weapon impulse forces.

26. The improvement of claim 22 wherein said ring gear is part of a bearing device mounted on said platform, and wherein said disk is removably attached to said bearing device whereby to permit disks with different weapons mounted thereon to be used with the vehicle.

27. A military vehicle having an unmanned turret system, said vehicle comprising;

a platform;

a plurality of stanchions connected at one end to the platform and at an opposite end to fixed portions of the vehicle;

a disk mounted for rotation on the platform about an axis extending generally normal to the plane of the platform;

mounting means connected to the disk for receiving a weapon, with said weapon being adapted to pivot in elevation about a pair of trunnions disposed in a plane generally parallel to the plane of the disk;

elevation drive means for controlling elevation of the weapon, said means including first and second portions rotatably coupled together at their inner ends, said first portion being located within the vehicle and centrally disposed about the axis of rotation of the disk, with the opposite end of said second portion being coupled to the weapon, and means for imparting axial movement to said first portion whereby said movement controls elevation of said weapon, with the second portion being capable of rotating with the weapon during azimuth positioning thereof;

at least one seat in the vehicle for a gunner, said seat being spaced from said disk and being mounted to the vehicle so that it is free from rotation with the disk;

azimuth drive means for rotating the disk to control azimuth positioning of the weapon;

control means accessible from the gunner's seat and coupled to the elevation and azimuth drive means for positioning and firing the weapon; and said stanchions including an outer casing and an energy absorbing material filling the outer casing, and being of different material than the outer casing whereby said stanchions absorb impulse forces generated during firing of the weapon to thereby minimize the transfer of the forces to the vehicle.

28. The vehicle of claim 27 wherein said elevation drive means includes:

an upper yoke member comprising said second portion connected by way of a ball and socket joint to a shaft which comprises said first portion, upper ends of the yoke being connected to the weapon mounting means and lower portions of the shaft being engaged with a gearing arrangement for controlling vertical movement thereof.

29. The vehicle of claim 28 wherein said gearing arrangement includes a rack connected to the shaft, a pinion engaging the rack, and means, including the control means, for selectively rotating said pinion.

30. The vehicle of claim 28 which further includes exterior side doors adjacent each seat.

31. The vehicle of claim 29 wherein said azimuth drive means includes:

bearing means having a ring gear with teeth;

means for removably mounting said disk to the ring gear; and a second pinion engaging said gear ring for rotating the disk and moving the weapon in azimuth.

32. The vehicle of claim 31 wherein the vehicle includes a roof spaced from said platform and including an opening in which said disk is located, and weather seal means between upper portions of said disk and said roof bridging said ring gear.

33. The vehicle of claim 32 wherein said weather seal means includes a resilient portion contacting the roof whereby friction energy created by relative motion between the platform and roof serves to absorb a portion of the weapon energy during firing and isolates the vehicle roof from weapon impulse forces.

34. The vehicle of claim 31 wherein said pinions of the elevation and azimuth drive means are rotatable either by a motor actuated by power drive control means or manually by a manual control means.

35. A military vehicle comprising:

a platform connected to the vehicle;

a plurality of stanchions connecting said platform to the vehicle, each of said stanchions including an outer casing and an energy absorbing material filling the casing, and being of different material than the casing whereby said stanchions flex during firing of the weapon to thereby minimize the transfer of weapon impulse forces to the vehicle;

a disk rotatably mounted on the platform;

a weapon mounted on the disk and capable of pivoting in elevation;

azimuth drive means for rotating the disk thereby positioning the weapon in azimuth;

elevation drive means for controlling elevation of the weapon;

a seat for a gunner within the interior of the vehicle;

power control means accessible from the gunner's seat and including at least one motor for activiting the elevation and azimuth drive means; and manual control means accessible from the gunner's seat for manually actuating the elevation and azimuth drive means as a back-up to the power control means.

36. The vehicle of claim 35 wherein said elevation drive means includes:

a first elongated member centrally located about the axis of rotation of said disk, a second member coupled at the weapon, and means defining a rotating coupling between the first and second members constructed so that vertical movement of the first member controls elevation of the weapon, with said second member being capable of rotating with the weapon during azimuth positioning thereof.

37. The vehicle of claim 36 wherein said first member comprises a rack, the elevation drive means includes a pinion for engaging the rack, with the power control means including a motor for imparting rotational movement to the pinion thereby controlling vertical movement of the rack, and wherein said manual control means includes means for manually rotating the pinion.

38. The vehicle of claim 36 wherein said azimuth drive means includes:

a ring gear mounted to the periphery of the disk and having radially outwardly extending teeth, a second pinion mounted on the platform and engaging said ring gear, with said power control means including a motor for imparting rotational movement to the second pinion and wherein said manual control means includes means for manually rotating said second pinion.

39. The vehicle of claim 38 wherein:

said power control means includes a joy stick controller adapted to selectively activate the moors for imparting rotation to the pinions of the elevation and azimuth drive means to thereby automatically control the position of the weapon; and said manual control means includes a first wheel coupled to the pinion of the elevation drive means, with the first wheel being capable of being manually rotated by the gunner from his seat to thereby manually position the weapon in elevation, and said manual control means further including a second wheel coupled to the second pinion of the azimuth drive means, with the second wheel being capable of being manually rotated by the gunner from his seat to thereby manually position the weapon in azimuth.

40. The vehicle of claim 39 wherein said vehicle is a land vehicle having a plurality of forward looking seats, one of the seats being said gunner's seat, and wherein said vehicle further includes exterior side doors adjacent each seat.

41. The vehicle of claim 40 wherein the vehicle includes a roof portion having an opening therein, said platform being located within said opening and spaced from said roof, with the vehicle further including weather seal means between said disk and said roof bridging said ring gear.

42. The vehicle of claim 41 wherein said weather seal means includes a resilient portion contacting the roof whereby friction energy created by relative motion between the platform and roof serves to absorb a portion of the weapon energy during firing and isolates the vehicle roof from weapon impulse forces.

43. The vehicle of claim 40 wherein each of said stanchions comprises:

a metallic outer casing and an interior hollow tube, and energy absorbing elastomeric material filling the space between the tube and inner walls of the casing.

44. The vehicle of claim 43 which includes a frame having a pair of side rails running parallel to the length of the vehicle, and wherein said stanchions are connected between the platform and the side rails substantially equally spaced about the weapon.

45. The vehicle of claim 38 wherein said ring gear is part of a bearing device mounted on said platform, and wherein said disk is removably attached to said bearing device whereby to permit disks with different weapons mounted thereon to be used with the vehicle.

* * * * *